United States Patent [19]

d'Hondt et al.

[11] Patent Number: 5,041,718

[45] Date of Patent: Aug. 20, 1991

[54] METHOD AND DEVICE FOR FIXING A POWDER IMAGE ON A RECEIVING SUPPORT

[75] Inventors: Arnold A. P. M. d'Hondt, Velden; Rob F. M. Jaartsveld, Amsterdam, both of Netherlands

[73] Assignee: Oce-Nederland B.V., Netherlands

[21] Appl. No.: 397,581

[22] Filed: Aug. 23, 1989

[30] Foreign Application Priority Data

Sep. 7, 1988 [NL] Netherlands ..... 8802202

[51] Int. Cl.[5] ..... D06F 75/24; B21B 27/06; H05B 3/02; G03G 15/20

[52] U.S. Cl. ..... 219/255; 219/216; 219/470; 355/208; 355/282; 355/285; 355/290

[58] Field of Search ..... 355/282, 285, 289, 290, 355/77, 204, 208, 206; 219/469, 470, 255, 216

[56] References Cited

U.S. PATENT DOCUMENTS

| | | | |
|---|---|---|---|
| 4,585,325 | 4/1986 | Euler | 219/470 X |
| 4,668,075 | 5/1987 | Shigemura et al. | 355/206 |

FOREIGN PATENT DOCUMENTS

| | | | |
|---|---|---|---|
| 0114168 | 7/1982 | Japan | 355/289 |
| 0176078 | 10/1982 | Japan | 355/290 |
| 0022165 | 2/1985 | Japan | 355/285 |
| 0249175 | 12/1985 | Japan | 355/289 |
| 0263173 | 12/1985 | Japan | 355/285 |

*Primary Examiner*—A. T. Grimley
*Assistant Examiner*—J. E. Barlow, Jr.
*Attorney, Agent, or Firm*—Reed, Smith, Shaw & McClay

[57] ABSTRACT

A device for fixing a powder image on a receiving support using heat that consists of an image transfer roller internally provided with a first heating element having the same heat-generating power over the entire length of the image transfer roller, and a second heating element which has a higher heat-generating power in the edge zones of the image transfer roller than in the middle zone of the roller, and a pressure roller internally provided with a third heating element which like the second heating element has a higher heat-generating power in the edge zones than in the middle zone. The device may be in a warm-up condition in which the temperature of the rollers is not yet at the working level, stand-by condition in which the temperature is at the working level but in which no fixing is carried out, and a fixing condition in which fixing is carried out. During warm-up, all the heating elements generate the maximum power. During stand-by, the first heating element is switched off and the effective powers of the second and third heating elements are set to a much lower value, so that the ratio between the amount of heat generated in the edge zones and the amount of heat generated in the middle zone is greater than during warm-up. During fixing, the effective powers of all three heating elements are set to a higher value than during stand-by, but the ratio between the amount of heat generated in the edge zones and the amount of heat generated in the middle zone is lower than during stand-by.

9 Claims, 2 Drawing Sheets

METHOD AND DEVICE FOR FIXING A POWDER IMAGE ON A RECEIVING SUPPORT

FIELD OF THE INVENTION

The present invention relates to a method and device for fixing a powder image on a receiving support by means of heat from a heating element wherein the amount of heat generated per unit of time during a period in which fixing is carried out is greater than during a stand-by period in which no fixing occurs.

BACKGROUND OF THE INVENTION

U.S. Pat. No. 3,398,259 discloses a copying electrical heating elements which, during a stand-by period in which fixing is not carried out, are connected in series in order to generate per unit of time a quantity of heat sufficient to keep the fixing device hot while, during a period in which fixing is carried out, only one of the groups is switched on in order to generate per unit of time a greater quantity of heat than during stand-by. The two groups can also be connected in parallel in order to generate per unit of time a quantity of heat which is even greater during a period in which the fixing device is heated up. The fixing device is provided with a temperature sensor which, when a temperature sufficient for fixing is reached, switches the fixing device over from the warm-up condition to the stand-by condition.

During stand-by periods, this fixing device will give up the most heat to the surroundings in those areas adjacent the surroundings, i.e. particularly the ends of the heating elements, and hence more in the edge zones than in the middle zone. During fixing, there is an extra heat yield to the image-bearing parts moving closely past the heating elements, such as the receiving support. This extra heat yield is substantially equal over the entire length of the heating elements In a copying machine of the kind in which a powder image is transferred from a photo-conductive support to a pre-heated receiving support via an image transfer medium in pressure contact both with the photoconductor and the receiving material, this extra heat yield transfer takes place to the photo-conductive support.

This copying machine and the method used therein have the disadvantage that the receiving support is heated nonuniformly in the direction transversely to the direction in which the receiving support is moved past the heating elements. Thus, it may readily happen that the temperature goes outside the temperature range in which good fixing is possible. Similar devices are also shown in U.S. Pat. No. 3,790,747 and Japanese Abstract No. 54-88134.

U.S. Pat. No. 4,301,359 discloses a fixing apparatus which always generates a fixed amount of heat per unit time, which amount is smaller in the middle zone of the heating element than in the edge zones thereof. Japanese Abstract No. 61-277986 discloses a device wherein the amount of heat generated per unit of time during fixing is less than that generated during stand-by. This device uses two temperature sensors which control two separate heating elements.

It should also be noted that U.S. Pat. No. 4,001,545 discloses a heat fixing device with a heating element comprising a first part and a second part both extending in the transverse direction, wherein in the first part the ratio between the amounts of heat generated per unit of time in a middle zone and in adjacent edge zones is less than said ratio in the second part. In this device, the amount of heat generated by the first part per unit of time is controlled via a temperature sensor in one of the edge zones, while the amount of heat that the second part generates per unit of time is controlled via a temperature sensor in the middle zone. Thus, this device requires two separate control circuits to control the temperature in the device thereby making the device unnecessarily complicated. A similar device is shown in Japanese Abstract No. 53-13432.

It would be desirable, therefore, to develop a method and device for fixing a powder image on a receiving support by means of heat which did not suffer from these disadvantages.

SUMMARY OF THE INVENTION

Generally, the method according to the present invention is such that the amount of heat generated per unit of time by the heating element in a middle zone as considered in the direction transversely of the direction of movement of the receiving support is smaller than in the adjacent edge zones and in that the ratio between the amount of heat generated per unit of time in the edge zones and the amount of heat generated per unit of time in the middle zone is set to a higher value during the stand-by period than during the period in which fixing is carried out.

The present invention provides a device for fixing a powder image on a receiving support by means of heat, comprising a heating element extending in the direction transversely of the direction in which the receiving support is moved past the heating element, for fixing a powder image applied to the receiving support, which device may be in a stand-by condition in which the device is at a temperature sufficient for fixing but in which the device is not set to fixing, and in a fixing condition in which the device is set to fixing, in which fixing condition the heating element generates per unit of time an amount of heat which is greater than the amount of heat generated per unit of time in the stand-by condition. The heating element comprises a first part and a second part both extending in the transverse direction, in which first part the ratio between the amount of heat generated per unit of time in the edge zones at the ends of the heating element and a middle zone situated therebetween, is greater than said ratio in the second part. Adjusting means are provided for setting the ratio between the amount of heat generated per unit of time by the first part and the amount of heat generated per unit of time by the second part to a higher value in stand-by condition than the value of said ratio in the fixing condition.

As a result, the temperature of the fixing device can be readily kept within a narrow temperature range over the entire length of a heating element. Since the present invention provides a different heat yield profile during stand-by and during fixing, the amount of heat generated in the fixing device during stand-by and during fixing can be controlled on the basis of the measured temperature at one place in the fixing device, for example in the middle.

According to another aspect of the present invention, the ratio between the amount of heat generated per unit of time in the edge zones and the amount of heat generated per unit of time in the middle zone during a period when the heating element is heated up is set to a lower value than during the stand-by period, in which no fixing is carried out for a long period. Preferably, a second adjustment means is provided for setting the said ratio to a lower value in the warm-up condition than the value of said ratio in the stand-by condition. Consequently, a uniform temperature is obtained during warm-up. This is based on the realization that during warm-up, each heating element of the fixing device is on average colder than during stand-by, so that the heat yield at the ends of the heating element in comparison with the total amount of heat generated in the same period of time is less during warm-up than during stand-by.

Preferably, the device of the present invention for fixing a powder image on a receiving support by means of heat consists of an image transfer roller internally provided with a non-profiled first heating element having the same heat-generating power over the entire length of the image transfer roller, and a profiled second heating element which has a higher heat-generating power in the edge zones of the image transfer roller than in the middle zone of said roller, and a pressure roller internally provided with a profiled third heating element which like the profiled second heating element has a higher heat-generating power in the edge zones than in the middle zone. The device may be in a warm-up condition in which the temperature of the rollers is not yet at the working level, stand-by condition in which said temperature is at the working level but in which no fixing is carried out, and a fixing condition in which fixing is carried out. During warm-up, all the heating elements generate the maximum power. During stand-by, the first heating element is switched off and the effective powers of the second and third heating elements are set to a much lower value, so that the ratio between the amount of heat generated in the edge zones and the amount of heat generated in the middle zone is greater than during the warm-up. During fixing, the effective powers of all three heating elements are set to a higher value than during stand-by, but the ratio between the amount of heat generated in the edge zones and the amount of heat generated in the middle zone is lower than during stand-by.

Other details, objects and advantages of the present invention will become more readily apparent from the following description of a presently preferred embodiment thereof.

BRIEF DESCRIPTION OF THE DRAWINGS

In the accompanying drawings, a preferred embodiment of the present invention is illustrated, by way of example only, wherein:

FIG. 3 shows in diagram form the relationships between heat and time for the edge and middle zones for each state namely, warm-up, standby and fixing.

DESCRIPTION OF THE PREFERRED EMBODIMENT

Figure 1:
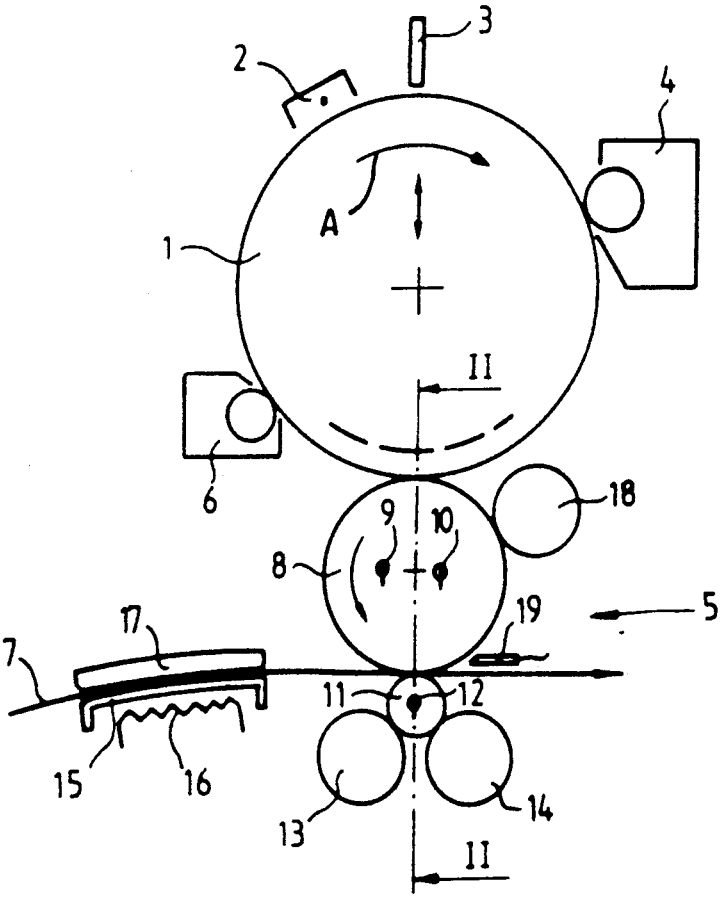
FIG. 1 is a diagrammatic cross-section of a part of an electrophotographic copying machine using a device according to the present invention.

The part of an electrophotographic copying machine represented in FIG. 1 comprises a photoconductive drum 1 which can rotate in the direction of the arrow A. The rotating photoconductive drum 1 successively passes the following: (i) a charging device 2 for uniformly charging the photoconductive surface of the drum 1; (ii) an image device 3 for image-wise discharge of a charged surface; (iii) a developing device 4 for developing the formed charge image with developing powder; (iv) a transfer and fixing device 5 for transferring the formed powder image to a receiving material 7, which device 5 will be described in greater detail hereinafter; and (v) a cleaning device 6 for removing residual developing powder from the photoconductive drum 1.

The transfer and fixing device 5 is provided with a hollow metal image transfer roller 8 covered with a layer of silicone rubber. Roller 8 is internally provided with two heating elements 9 and 10 for heating the silicone rubber layer on the outside of image transfer roller 8. The photoconductive drum 1 and the image transfer roller 8 respectively can be brought (by means not shown) into a position in which the drum 1 does not make contact with the image transfer roller 8 and a position in which the photoconductive drum 1 is in contact with the image transfer roller 8, in which latter position the photoconductive drum 1 and the image transfer roller 8 press against one another with a force sufficient to transfer the powder image from the photoconductive drum 1 to the heated silicone rubber layer of the image transfer roller 8. The means for accomplishing this, which are not shown may, for example, consist of the means described for that purpose in U.S. patent application Ser. No. 07/269,498 filed Nov. 10, 1988 entitled, "Image Transfer and Contact Fixing Device."

The transfer and fixing device 5 is also provided with a hollow metal pressure roller 11 which, like the image transfer roller 8, is covered with a layer of silicone rubber. Pressure roller 11 is internally provided with a heating element 12 for heating the silicone rubber layer on the outside of pressure roller 11. The latter is pressed against the image transfer roller 8 by two backing rollers 13 and 14, for example, in the manner described in the aforesaid U.S. patent application, with a force sufficient to transfer the powder image heated on the image transfer roller 8 and fuse it on receiving material 7 as it moves through the nip between the image transfer roller 8 and the pressure roller 11. The backing rollers 13 and 14 also ensure that developing powder and dust originating from the receiving material, which are landed on the pressure roller 11, are removed.

When considered in the direction of the feeding of the receiving material 7, a plate 15 is disposed in front of the fixing nip between the image transfer roller 8 and the pressure roller 11. Plate 15 can be heated by means of a heating element 16 and is covered by a biasing member 17. Before it reaches the fixing nip between the image transfer roller 8 and the pressure roller 11, receiving material 7 is fed between the heated plate 15 and the biasing member 17. The heating of plate 15 is so adjusted that receiving material 7 on reaching the fixing nip is preheated to a temperature which is somewhat below the fixing temperature that can prevail in the fixing nip.

In a part of the periphery of the image transfer roller 8 which is situated past the fixing nip when considered in the direction of rotation of the image transfer roller 8, a cleaning roller 18 is in contact with the image transfer roller 8 for the removal of developing powder and dust originating from the receiving material, which remains on the image transfer roller 8 after fixing.

Figure 2:
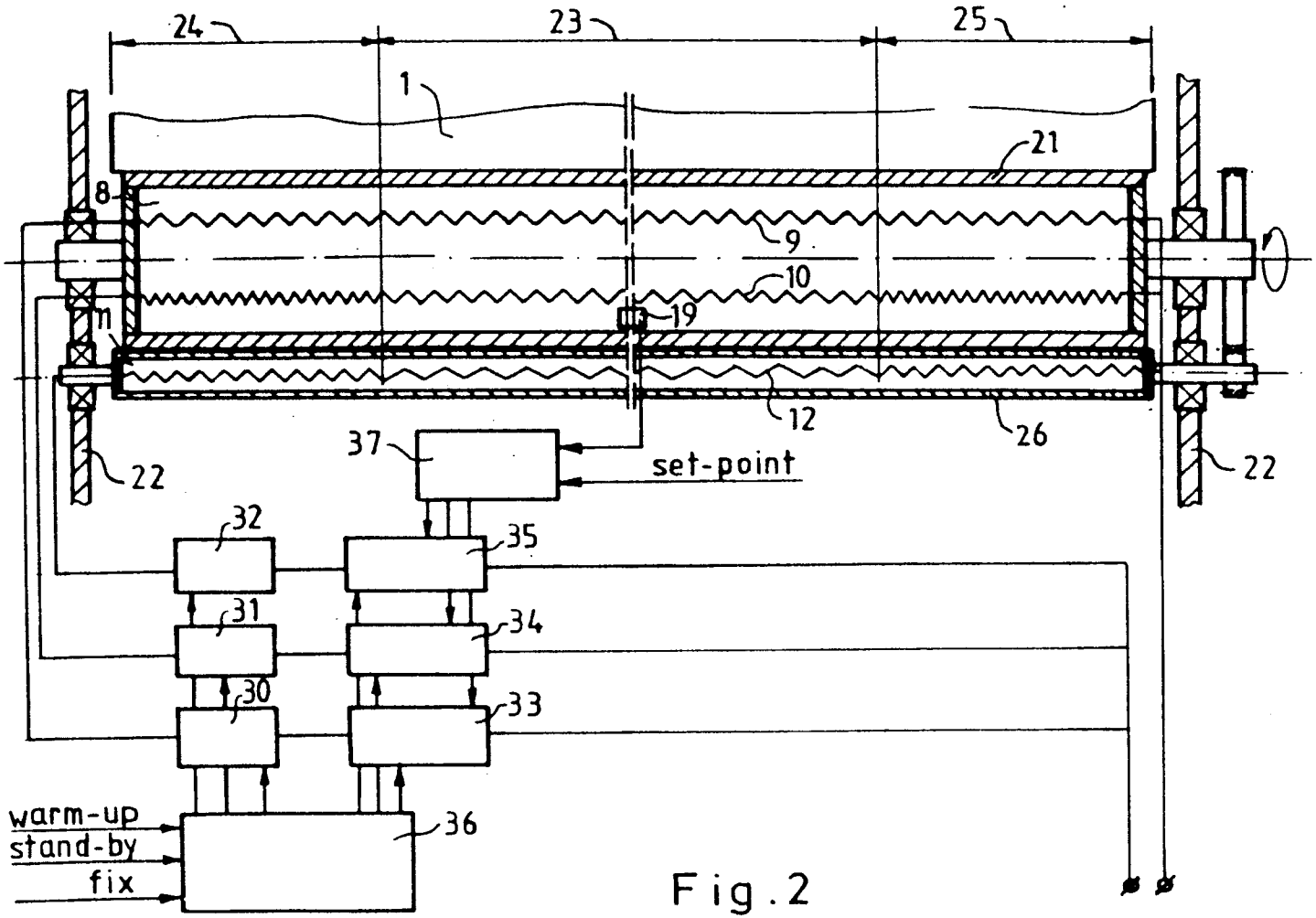
FIG. 2 is a cross-section taken along the line II-II shown in FIG. 1 with a diagram of the electrical connection of the device.

The transfer and fixing device 5 is also provided with a temperature sensor 19 which measures the temperature of the image transfer roller 8 in the immediate surroundings of the fixing nip. Temperature sensor 19 is a pyro-electric sensor which operates without contact and which measures the temperature at the surface of the image transfer roller 8 in a region which, when considered in the direction of the length of the image transfer roller 8, is situated in the middle of said roller 8 as shown in FIG. 2.

For a good transfer of developing powder from the photoconductive drum 1 to the image transfer roller 8, and from the latter to the receiving material 7, the developing powder must have a certain temperature. This temperature is obtained by bringing the silicone rubber layer on the image transfer roller 8 into a given working range. At a temperature of the image transfer roller 8 which is beneath the working range, the developing powder will not adhere properly to the receiving material 7 and will detach when the receiving material is folded or when the receiving material is subjected to rubbing. At a temperature of the image transfer roller 8 which is above the working range, a large part of the developing powder will remain sticking to the image transfer roller 8 after passing the fixing nip, so that there will be considerable soiling of the cleaning roller 18 and, in addition, developing powder stuck on the image transfer roller 8 may not be removed easily by the cleaning roller 18 and may be transferred to the photoconductive drum 1 and fuse thereon.

The photoconductive drum 1 must also be kept at a temperature far below the working range temperature of the image transfer roller 8 to prevent developing powder from fusing on the photoconductive drum and to prevent developing powder present as a reserve in the developing device 4 from becoming excessively hot and caking due to softening. To this end, the inside of the photoconductive drum 1 has cooling fins along which cooling air can be blown. Good results are obtained with temperatures of the image transfer roller 8 which are in a working range between 100° C. and 125° C., a temperature of the preheated receiving material 7 of 90° C. and a temperature of the photoconductive drum 1 which is below 45° C.

In the embodiment shown in the drawings, the image transfer roller 8 consists of a steel cylinder 21 having a diameter of 100 mm and a length of 1 m, covered with an approximately 2 mm thick layer of silicone rubber. Cylinder 21, as shown in FIG. 2, is mounted at its ends for rotation in the frame 22 of the copying machine. The heating elements 9 and 10 disposed adjacent one another inside the cylinder 21 consist of spirally wound electrical resistance wire, the spirals extending over the entire length of the cylinder 21. The heating elements 9 and 10 serve primarily for heating the image transfer roller 8 and the steel cleaning roller 18 which is permanently in contact therewith.

Heating element 9 has a uniform spiral winding and preferably has a heat-generating power of 1.6 W/mm over the entire length of the image transfer roller 8, and hence a total power of 1600 W. Heating element 10 has more spiral windings per unit of length at the ends than in the middle and preferably its maximum heat-generating power in the centrally situated middle zone 23 of the image transfer roller 8 over a length of 0.6 m is 1.6 W/mm (total 960 W) and in the adjacent edge zones 24 and 25, each 0.2 m in length, the maximum heat-generating power is 2.7 W/mm (540 W for each of zones 24 and 25) and hence a total power of 2040 W. In the middle zone 23 the combined maximum heat-generating power of both the heating elements 9 and 10 is 960 W+960 W=1920 W and in the edge zones 24, 25 the combined maximum heat-generating power is $2\times(320+540)=1720$ W.

Like the image transfer roller 8, the pressure roller 11 consists of a steel cylinder 26 having a length of 1 m but with a diameter of 25 mm and is covered with a layer of silicone rubber having a thickness of about 1 mm. This cylinder is also mounted for rotation at its ends in the frame 22 of the copying machine. The heating element 12 serves primarily to heat the pressure roller 11 and the steel backing rollers 13 and 14 which are permanently in contact therewith.

The heating element 12 inside cylinder 26 consists of an electrical resistance wire having more spiral windings per unit of length at the ends than in the middle zone 23 of the pressure roller 11. Over a length of 0.6 m in the middle zone it preferably has a heat-generating power of 1 W/mm (total 600 W) and in the adjacent edge zones 24 and 25, each 0.2 m in length, it preferably has a heat-generating power of 1.75 W/mm (total $2\times350$ W=700 W) and hence a maximum total power of 1300 W.

The relationships between heat and time for the edge zones and the middle zones of heating elements 9, 10 and 12 which are described hereinafter are shown diagrammatically in FIG. 3.

The heating elements 9, 10 and 12 together preferably have in the middle zone 23 a maximum heat-generating power of 1920 W+600 W=2520 W and in the edge zones 24 and 25 together a maximum heat-generating power of 1720 W+700 W=2420 W. The ratio between the maximum heat-generating power in the edge zones 24, 25 and the middle zone 23 is 640 W/960 W in the case of heating element 9, 1080 W/960 W in the case of heating element 10 and 700 W/600 W in the case of heating element 12 and hence together:

$$\frac{640\ W + 1080\ W + 700\ W}{960\ W + 960\ W + 600\ W} = 0.96$$

A switching element 30, 31 and 32, respectively, is provided in the electrical power supply line to each heating element 9, 10 and 12 to enable the electric current which can be fed to the associated heating element to be reduced in order to adjust the effective power delivered by the heating element to a power lower than the maximum power that the associated heating element can deliver, the ratio between the effective current and the maximum current representing the reduction factor.

The power delivered by the heating elements 9, 10 and 12 can also be controlled by periodically switching the power supply to each heating element 9, 10 and 12 on and off by means of a relay 33, 34 and 35, respectively. Doing this changes the on/off time ratio within fixed periods. The delivered power P is: $(I_{max}\times\text{reduction. factor})^2\times R\times(\text{on/off time ratio})$, where $I_{max}$ is the maximum electric current flowing through a heating element and R is the resistance of the heating wire. The distribution of the delivered power of the heating elements 9, 10 and 12 over the length thereof (i.e. the power profile) can be adjusted by changing the power ratio of the heating elements 9, 10 and 12, as will be explained hereinafter.

After it has been switched on, the copying machine may be in three conditions: (a) a warm-up condition in which the parts to be heated have a temperature below the working range (this condition typically applies when the machine is switched on after a long off period); (b) a stand-by condition, in which the temperature of the parts to be heated is within the working range but no copying is being done; and (c) a fixing condition in which the temperature of the parts to be heated is within the working range and copying is being done.

Heat must be supplied in each of these conditions by way of the heating elements to bring the image transfer roller 8 and the pressure roller 11 to the desired temperature and to hold it there. In these conditions, heat losses occur primarily in the edge zones of the rollers due to heat conduction to the fixing points of the heating elements and to the bearings and the roller drives due to thermal convection along the sides of the rollers and due to thermal radiation via the side surfaces of the rollers.

In the warm-up condition, the photoconductive drum 1 is disengaged from the image transfer roller 8. A high power must be dispensed in the image transfer roller 8 and in the pressure roller 11 in order that the cleaning roller 18 and backing rollers 13 and 14 may also be quickly brought up to the working range temperature apart from the rollers 8 and 11. During warm-up, the heat losses in the edge zones are relatively low because the average temperature difference between the rollers and the surroundings is low.

During warm-up the maximum power is fed to all the heating elements, and hence the reduction factor is 1 and the on/off time ratio is 1, until the temperature sensor 19 measures a set-point temperature within the working range at the image transfer roller 8. At the above mentioned working range of 100° C. to 125° C., this set-point temperature is preferably 120° C. The power distribution between the various heating elements can be selected so that at that time not only the image transfer roller 8 but also the other parts to be heated have reached a working range temperature applicable to each associated part. At a relatively high power of the heating elements in the image transfer roller 8 in comparison with the power of the heating element in the pressure roller 11, a feature favorable to keeping the device warm during copying, as will be explained hereinafter, the heating element 12 in the pressure roller 11 may be left at full power for a fixed time after reaching the set-point temperature in order to bring the backing rollers 13 and 14 to the working temperature.

After the set-point temperature (120° C.) is reached, the copying machine is automatically set to the stand-by condition or, if the copying machine has in the meantime been set to copying, the fixing condition. In the stand-by condition the transfer and fixing device 5 is at working temperature, but the heat losses in the edge zones increase in significance. This means that while less heat needs be supplied overall, more heat must be supplied to the edge zones than to the middle zone.

In the above-described embodiment, preferably the on/off time ratio of the heating element 9 is set to 0 and those of the heating elements 10 and 12 to 0.29. The current flowing through the heating elements 10 and 12 is preferably reduced by a factor such that: (i) the effective power of heating element 10 becomes 527 W, of which 1080/2040×527 W=279 W is in the edge zones 24, 25 and 960/2040×527 W=248 W is in the middle zone 23; and (ii) the effective power of heating element 12 becomes 96 W, of which 700/1300×96 W=51.7 W is in the edge zones 24, 25 and 600/1300×96 W=44.3 W is in the middle zone 23. The ratio between the power in the edge zones 24, 25 and the middle zone 23 is thus set during stand-by to:

$$\frac{279\ W + 51.7\ W}{248\ W + 44.3\ W} = 1.13$$

which is a higher value than during warm-up which is 0.96.

In the fixing condition, the relatively cold photoconductive drum 1 is in pressure contact with the image transfer roller 8. To keep the transfer and fixing device 5 in this condition at a temperature which is within the working range, a significantly greater power must be supplied than during stand-by. The heat losses to the photoconductive drum 1 occur substantially uniformly over the entire length of the image transfer roller. For this reason, extra heat must be supplied in the fixing condition particularly by heating element 9 in comparison with the stand-by condition.

In the above-described embodiment, the on/off time ratio of all the heating elements is preferably set to 0.64 in the fixing condition. The current flowing through the heating elements 9, 10 and 12 is also reduced by a factor such that: (i) the effective power of heating element 9 becomes 689 W, of which 640/1600×689 W=275.6 W in the edge zones 24, 25 and 960/1600×689 W=413.4 W in the middle zone 23; (ii) the effective power of heating element 10 becomes 746 W, of which 1080/2040×746 W=395 W in the edge zones 24, 25 and 960/2040×746 W=351 W in the middle zone 23; and (iii) the effective power of heating element 12 becomes 193 W, of which 700/1300×193 W=104 W in the edge zones 24, 25 and 600/1300×193 W=89 W in the middle zone 23.

The ratio between the power in the edge zones 24, 25 and the middle zone 23 is thus set during fixing to the following:

$$\frac{275.6\ W + 395\ W + 104\ W}{413.3\ W + 351\ W + 89\ W} = 0.9$$

which is a lower value than during stand-by which is 1.13.

The ratio between the maximum heat-generating powers in the edge zones 24, 25 and the middle zone 23 of the two profiled heating elements 10 and 12 (first part) is:

$$\frac{1080\ W + 700\ W}{960\ W + 600\ W} = 1.14$$

and of the non-profiled heating element 9 (second part) is 640 W/960 W=0.66. The ratio between the power ratios of the first part and the second part during stand-by and fixing is:

$$\frac{527 + 96}{0} : \frac{746 + 193}{689}$$

This ratio between the power ratios of the first part and the second part during warm-up and stand-by is:

$$\frac{2040 + 1300}{1600} : \frac{527 + 86}{0}$$

and is therefore smaller than the ratio of said powers during stand-by and fixing.

On the basis of the existing condition of the copying machine, the warm-up condition after the machine has been switched on, the stand-by condition after the transfer and fixing device of the copying machine has reached working range temperature, or the fixing condition after actuation of a print button of the copying machine, an adjusting computer 36 automatically sets the reduction factor of the switching elements 30, 31 and 32 and the on/ off time ratio of the relays 33, 34 and 35 to preset values associated with the activated conditions.

In the stand-by and fixing conditions, a time-proportional controller 37 is automatically switched on which for the three heating elements 9, 10 and 12 jointly controls the on/off time ratio for temperature control based on the set-point temperature. In stand-by, this set-point temperature is set to a higher value within the working range than during fixing to prevent the temperature from coming below the working range due to the sudden temperature fall which occurs with the arrival of the cold photoconductive drum 1 at the start of fixing. At a working range of 100° C. to 125° C., usable set-point adjustments for this purpose are 120° C. and 110° C., respectively. In each loading situation, the controller 37 holds the temperature of the image transfer roller 8 within the working range so that copying is possible without waiting times. A proportional and differential controller is sufficient for this purpose.

Alternatively, instead of the combination just described, adjustment of the current strength and the on/off time ratio by adjusting computer 36 and control of the on/off time ratio by controller 37, both the adjustment and the control can also be provided by varying only the on/off time ratio at full current strength.

Test measurements carried out on a prototype of the above-described embodiment show that directly after warm-up a somewhat higher temperature is present in the edge zones than in the middle zone (+4° C. difference). In the event of the machine staying in stand-by for a long time, a slightly lower temperature occurs in the edge zones than in the middle zone (−8° C. difference). During copying, the temperature difference is less than 2° C.

While a presently preferred embodiment of practicing the invention has been shown and described with particularity in connection with the accompanying drawings, the invention may otherwise be embodied within the scope of the following claims.

What is claimed is:

1. A method of fixing a powder image on a receiving support by means of heat comprising: (a) moving the receiving support past a heating element; (b) generating an amount of heat per unit of time in the heating element during a period in which fixing is carried out which is greater than the amount of heat generated during a stand-by period in which no fixing occurs but there is a temperature sufficient for fixing; and (c) generating an amount of heat per unit of time and per unit of length of the heating element in a middle zone of the heating element when considered in the direction transversely of the direction of movement of the receiving support which is smaller than in adjacent edge zones of the heating element such that the ratio between the amount of heat generated per unit of time in the edge zones and the amount of heat generated per unit of time in the middle zone is preset at a higher value during the stand-by period than during a period in which fixing occurs.

2. The method as described in claim 1, further comprising the step of: generating heat in the heating element such that the ratio between the amount of heat generated per unit of time in the edge zones and the amount of heat generated per unit of time in the middle zone during a warm-up period is set to a lower value than during the stand-by period.

3. A device for fixing a powder image on a receiving support in a nip formed by an image fixing roller and a pressure roller by means of heat from a heating unit extending in the direction transversely of the direction in which the receiving support is moved past the heating unit, which device may be in a stand-by condition in which the device is at a temperature sufficient for fixing but in which the device is not set to fixing, and in a fixing condition in which the device is set to fixing and the amount of heat generated per unit of time is greater than the amount of heat generated per unit of time in the stand-by condition, the heating unit comprising a first heating element and a second heating element, both heating elements extending in the transverse direction to that in which the receiving support is moved past the heating unit such that, the ratio between an amount of heat generated per unit of time in edge zones at the ends of each heating element and in a middle zone situated between the ends of each heating element, is greater in the first heating element than in the second heating element, and in that an adjusting means is provided for adjusting the ratio between the amount of heat generated per unit of time by the first heating element and the amount of heat generated per unit of time by the second heating element to a higher value in a stand-by condition than the value of said ratio in a fixing condition.

4. The device as described in claim 3 wherein as the heating unit is heated up in a warm-up condition, the adjusting means sets the ratio to a lower value than the value of the ratio in the stand-by condition.

5. The device as described in claim 3 wherein the first heating element comprises a profiled heating element and the second heating element comprises a non-profiled heating element.

6. The device as described in claim 5 wherein the first heating element has more windings per unit length in the ends than in the middle and the second heating element has a uniform number of windings per unit length.

7. The device as described in claim 6 wherein the first and second heating elements are located in the image fixing roller.

8. The device as described in claim 6 wherein the first heating element comprises at least two profiled heating elements.

9. The device as described in claim 8 wherein the first profiled heating element is located within the image fixing roller and the second profiled heating element is located within the pressure roller.

* * * * *